US009651323B1

(12) United States Patent
Mantas

(10) Patent No.: US 9,651,323 B1
(45) Date of Patent: May 16, 2017

(54) TELESCOPIC RECOIL SYSTEM FOR FIREARMS

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 97 days.

(21) Appl. No.: 14/930,901

(22) Filed: Nov. 3, 2015

(51) Int. Cl.
*F41A 25/00* (2006.01)
*F41A 3/86* (2006.01)
*F41A 3/66* (2006.01)

(52) U.S. Cl.
CPC . *F41A 3/86* (2013.01); *F41A 3/66* (2013.01)

(58) Field of Classification Search
CPC ..... F41A 3/78; F41A 3/80; F41A 3/82; F41A 3/84; F41A 3/86; F41C 23/06
See application file for complete search history.

(56) References Cited

U.S. PATENT DOCUMENTS 898,038 A * 9/1908 Clarus ..... F41A 3/86 42/69.03
1,877,839 A * 9/1932 Frommer ..... F41A 3/86 89/177
2,779,249 A * 1/1957 Saetter-Lassen ..... F41A 3/84 89/198
3,731,590 A * 5/1973 Zimmerman, Jr. ..... F41A 25/22 89/163
4,201,113 A * 5/1980 Seecamp ..... F41A 3/86 89/163
7,261,029 B1 * 8/2007 Davis ..... F41A 17/36 42/16
7,493,845 B2 2/2009 Mantas
8,800,424 B2 * 8/2014 Gangl ..... F41A 3/84 89/198
9,080,823 B1 7/2015 Mantas
9,267,747 B2 * 2/2016 Caudle ..... F41A 3/84

FOREIGN PATENT DOCUMENTS

CH 362341 A * 5/1962 ..... F41A 3/46
FR 1151326 A * 1/1958 ..... F41A 3/46

* cited by examiner

*Primary Examiner* — Gabriel Klein
(74) *Attorney, Agent, or Firm* — Notaro, Michalos & Zaccaria P.C.

(57) ABSTRACT

A telescopic recoil system for a firearm having a receiver and a bolt carrier includes a recoil system base, an axle fixed to the base, a central buffer tube slidably mounted on the axle, an axle buffer spring between the base and central buffer tube, biasing the central buffer tube away from the base, an outer tube slidably mounted on a forward portion of the central buffer tube, a spring buffer tube slidably mounted on a rearward portion of the central buffer tube, a rear buffer spring between the base and spring buffer tube, biasing the spring buffer tube away from the base, a central spring between the spring buffer tube and outer tube, biasing the outer tube away from the spring buffer tube and away from the base and an exchangeable spring between the outer tube and the bolt carrier, biasing the outer tube away from the bolt carrier.

20 Claims, 4 Drawing Sheets

FIG. 1 (PRIOR ART)
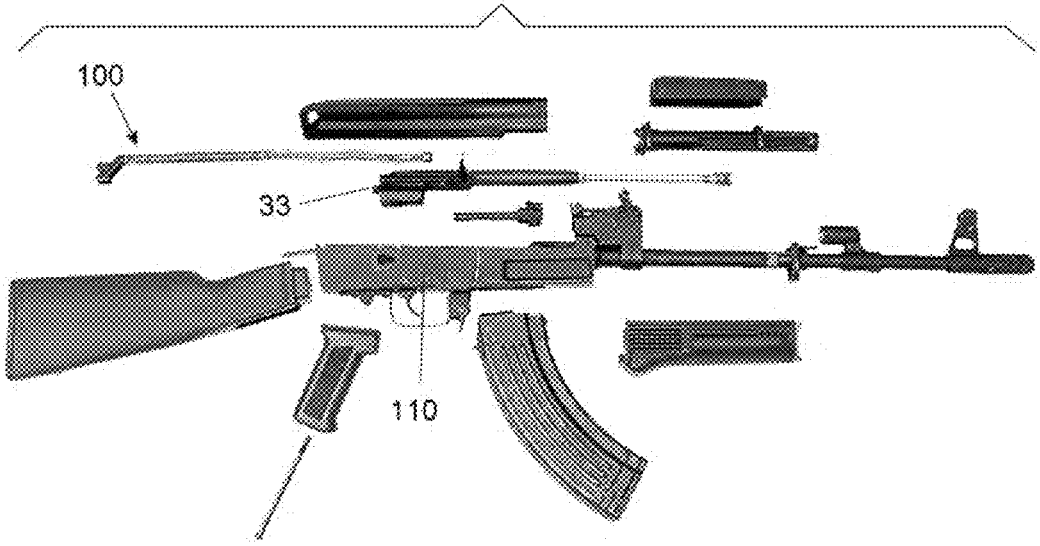
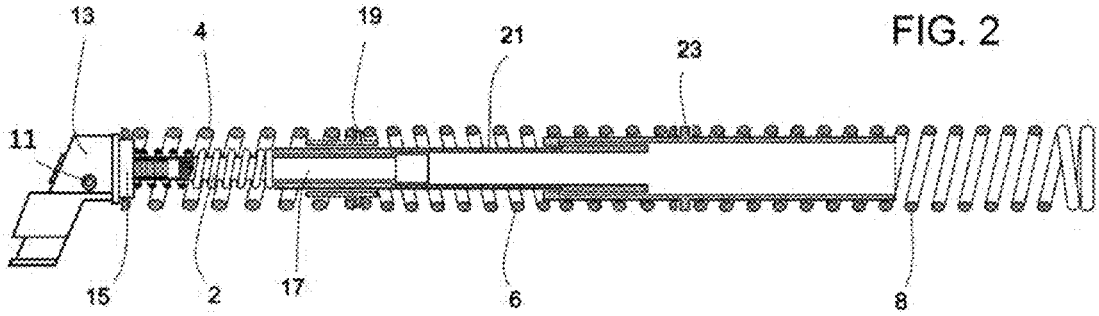
FIG. 2

TELESCOPIC RECOIL SYSTEM FOR FIREARMS

FIELD AND BACKGROUND OF THE INVENTION

The present invention relates generally to the field of firearms and in particular to a new and useful recoil system For AK style and other firearms.

The inventor's previous U.S. Pat. No. 7,493,845 discloses a recoil mechanism for a gun having a frame, a barrel and a slide, the mechanism having a cylinder with a rear part with external flange and an internal diaphragm spaced forwardly of the flange and between a rear chamber and a front chamber in the cylinder. A nut is fixed to the frame and an axle has a rear end threaded to the nut and extending in the cylinder. The axle has a collar trapped in the front chamber by the diaphragm. A first spring around the cylinder, has a front end abutting the slide and a rear end abutting the flange. A second spring extending at least partly in the rear chamber has a rear end abutting the nut and a front end abutting the diaphragm. A third spring in the front chamber, is shorter in length than the front chamber and a recoil adjusting plug is used with or without the recoil mechanism.

The inventor's U.S. Pat. No. 9,080,823 discloses a buffer assembly for an AR type firearm, having a rod and a cap with a forward end against which a bolt carrier pushes during a firing cycle. The cap is movable along the rod. A shock absorbing plug is attached to a rearward end of the rod for engaging an end wall of a receiver extension during an intermediate part of the firing cycle, a buffer tube is moveable on the rod, a buffer spring is engaged between the plug and the buffer tube for biasing the buffer tube toward a forward position and a counterweight is mounted for movement on the rod. A shock absorbing washer is provided between the counterweight and the cap for smoothing an impact between the counterweight and the cap at an end of the firing cycle and a counterweight spring that is weaker than the buffer spring, is provided for biasing the counterweight toward the cap.

A need remains for further improvements in the recoil and/or buffer mechanisms of firearms to improve their dynamic characteristics, and this disclosure addresses some aspects of that need.

SUMMARY OF THE INVENTION

It is an object of the present invention to provide a telescopic recoil system for a firearm having a receiver and a bolt carrier, the system including recoil system base, an axle fixed to the base, a central buffer tube slidably mounted on the axle, an axle buffer spring between the base and central buffer tube, biasing the central buffer tube away from the base, an outer tube slidably mounted on a forward portion of the central buffer tube, a spring buffer tube slidably mounted on a rearward portion of the central buffer tube, a rear buffer spring between the base and spring buffer tube, biasing the spring buffer tube away from the base, a central spring between the spring buffer tube and outer tube, biasing the outer tube away from the spring buffer tube and away from the base and an exchangeable spring between the outer tube and the bolt carrier, biasing the outer tube away from the bolt carrier.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is an exploded view of a known AK type rifle also known as a Kalashnikov in honor of its developer, Mikhail Kalashnikov;

FIG. 2 is a sectional, assembled view of the telescopic recoil system of the invention for use in AK type or other firearm;

DESCRIPTION OF THE PREFERRED EMBODIMENTS

Figure 3:
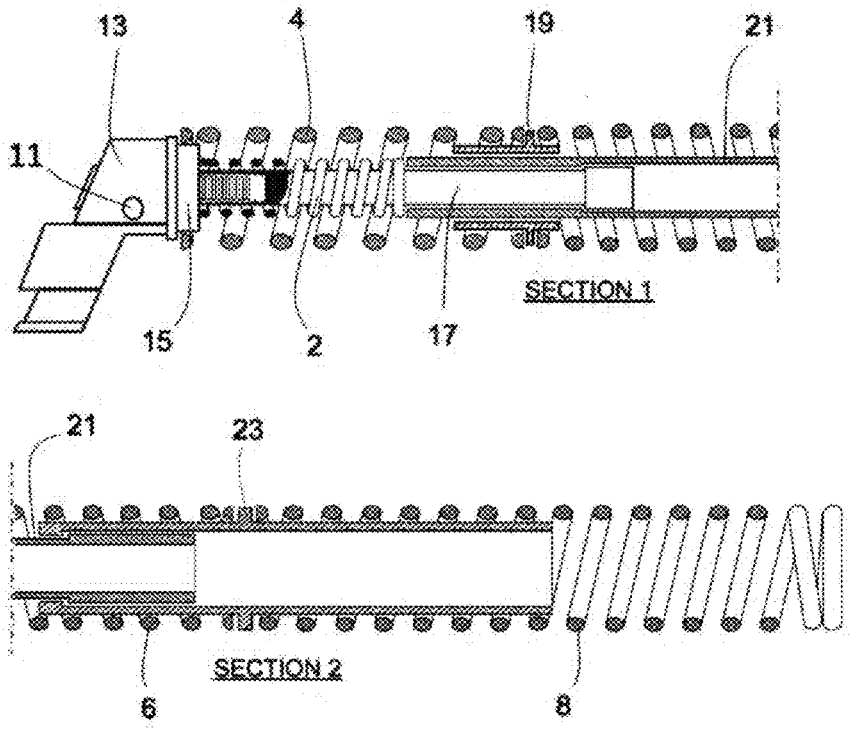
FIG. 3 is an enlarged view similar to FIG. 2 illustrating additional details of the invention.

Referring now to the drawings, in which like reference numerals are used to refer to the same or similar elements, FIG. 1 shows a known firearm of the AK type, having bolt carrier 33 that moves rearwardly in a receiver 110 of the firearm when the fire arm is loaded and the trigger has been pulled, to initiate a firing cycle. This movement is against the forward biasing action of a known recoil mechanism 100 of the firearm, the recoil mechanism 100 moving the bolt carrier forwardly in the receiver during the later phase of the firing cycle to load the next round.

Figure 4:
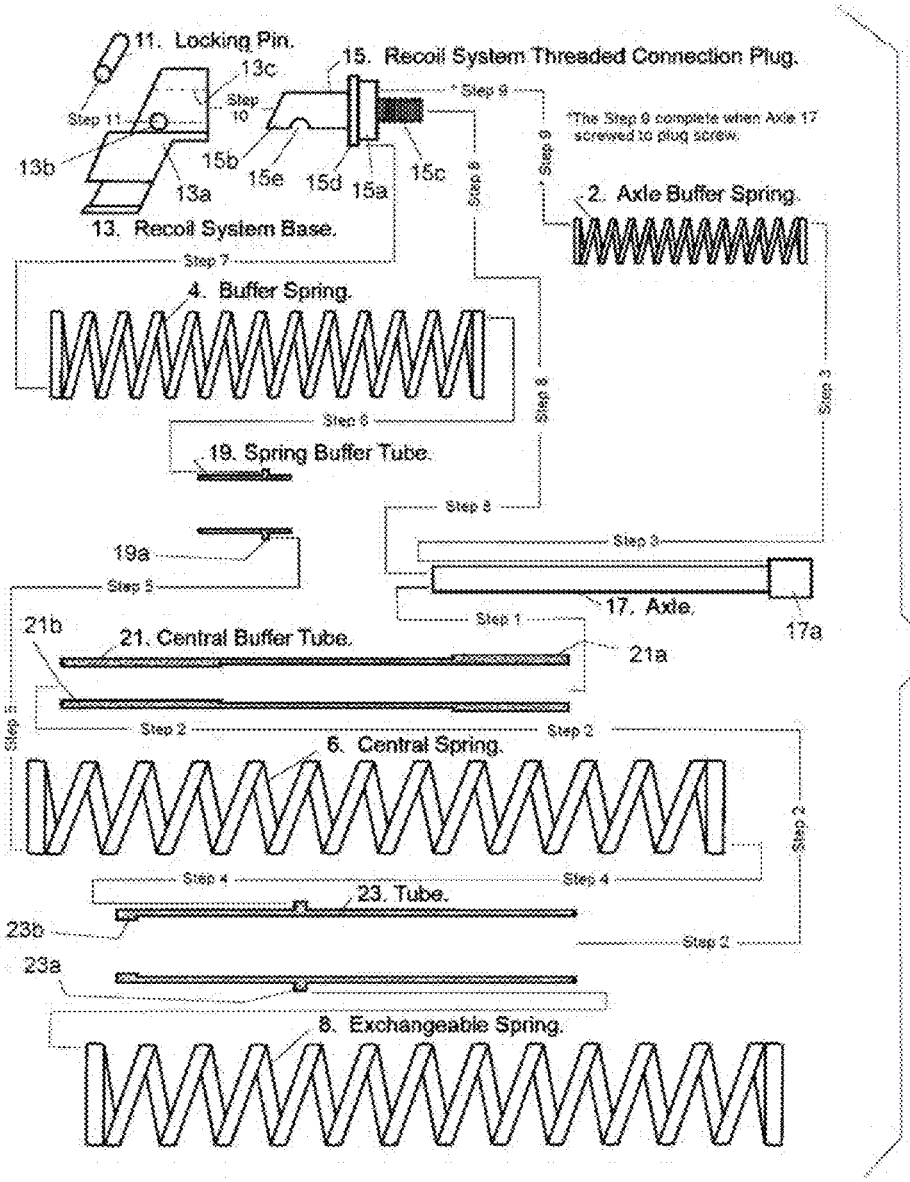
FIG. 4 is an exploded view of the system of FIGS. 2 and 3, separated into its component parts and illustrating an example of a sequence of its assembly.

According to the invention, the known recoil mechanism 100 of FIG. 1 is replaced by a telescopic recoil system of the invention, shown in FIGS. 2, 3 and 4, which comprises a recoil system base 13, an axle 17 fixed to the base 13, a central buffer tube 21 slidably mounted on the axle 17, an axle buffer spring 2 engaged between the base 13 and the central buffer tube 21 for biasing the central buffer tube 21 away from the base 13, an outer tube 23 slidably mounted on a forward portion of the central buffer tube 21, a spring buffer tube 19 slidably mounted on a rearward portion of the central buffer tube 21, a rear buffer spring 4 engaged between the base 13 and the spring buffer tube 19 for biasing the spring buffer tube 19 away from the base 13, a central spring 6 engaged between the spring buffer tube 19 and the outer tube 23 for biasing the outer tube 23 away from the spring buffer tube 19 and away from the base 13, and an exchangeable spring 8 engaged between the outer tube 23 and the bolt carrier 33 for biasing the outer tube 23 away from the bolt carrier 33.

The recoil system base 13 includes a base portion 13*a* having an axial bore 13*c* and a transverse bore 13*b*, a threaded connection plug 15 having a plug portion 15*a* with flange 15*d*. A base extension 15*b* of the plug 15 extends into the axial bore 13*c* and a treaded portion 15*b* is threaded into the axle 17. The base extension 15*b* has a lower recess 15*e* and a locking pin 11 extends in the transverse bore 13*b* and across the recess 15*e* for locking the threaded connection plug 15 to the base portion 13*a*.

Figure 6:
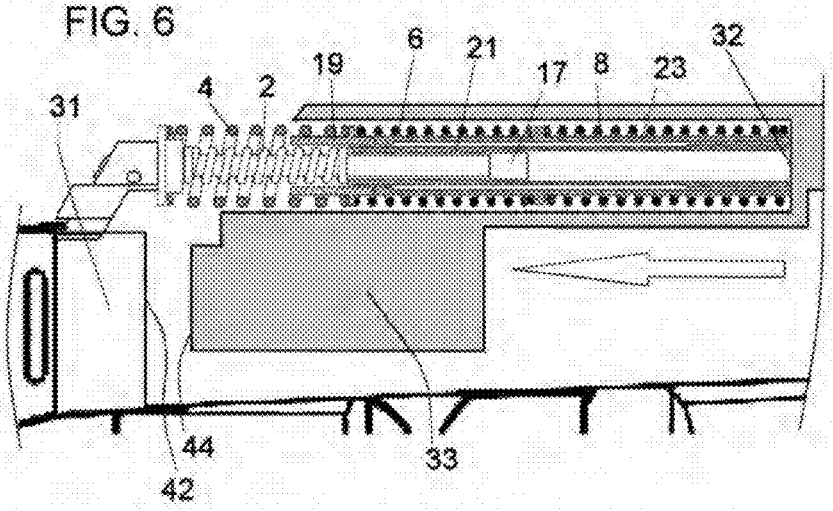
FIG. 6 is an enlarged view of the assembly of FIG. 5 illustrating a part of the compression phase for the system during a firing cycle, after the bolt carrier has moved back far enough to cycle a new round if necessary, but not all the way to a rear position of maximum compression for the system.
Figure 7:
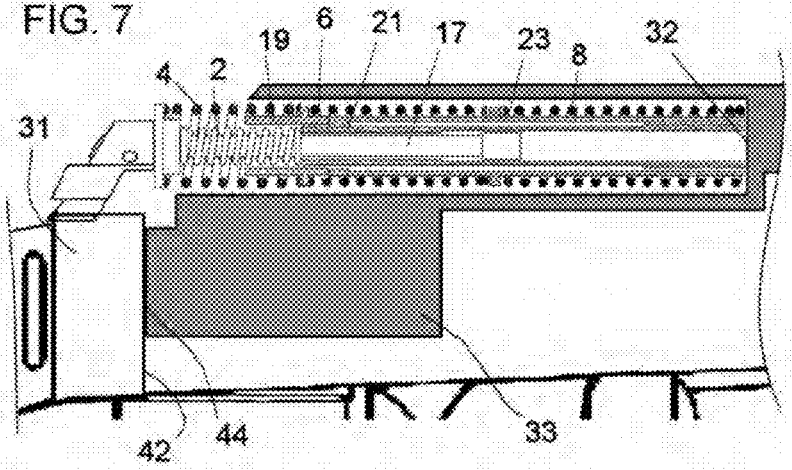
FIG. 7 is a view similar to FIG. 6 illustrating a later part of the compression phase after a buffering action of the system has occurred and the system is in a position of maximum compression, just before the system springs start to return the bolt carrier of the firearm to its forward, rest position of FIG. 5.

The telescopic recoil system of the invention requires the rear buffer spring 4 to have a higher compression resistance than the central spring 6 so that the rear buffer spring 4 compresses later than the central spring 6 during a firing cycle, as illustrated by FIGS. 6 and 7.

The spring buffer tube 19 includes a flange 19*a* for separating the rear buffer spring 4 from the central spring 6 on the spring buffer tube 19. The outer tube 23 includes a flange 23*a* for separating the central spring 6 from the exchangeable spring 8 on the outer tube 23.

To keep the system together, the central buffer tube 21 has a large outside diameter forward end 21*a* and the outer tube 23 has a small inside diameter rearward end 23*b* for engaging the large outside diameter forward end 21 a of central buffer tube 21 to retain the central buffer tube 21 to the outer tube 23. The axle 17 has a large outside diameter forward end 17*a* and the central buffer tube 21 has a small inside diameter rearward end 21*b* for engaging the large outside diameter forward end 17*a* of axle 17 retain the axle 17 to the central buffer tube 21.

Figure 5:
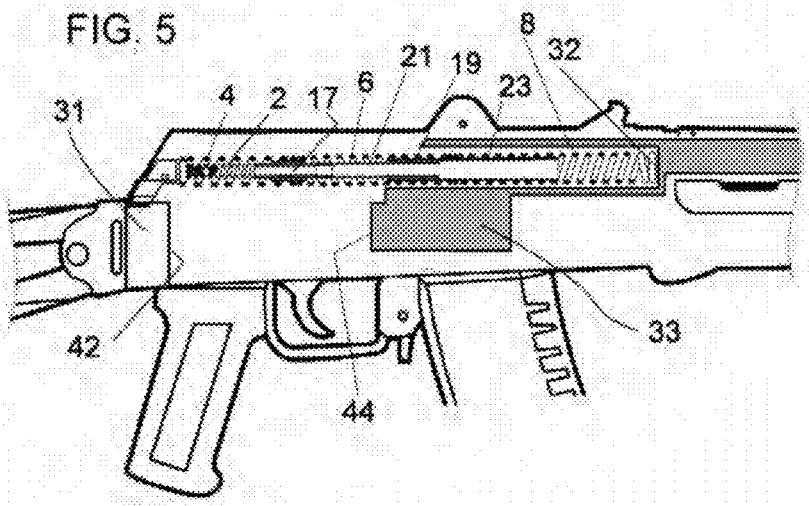
FIG. 5 is sectional view of the telescopic recoil system of the invention and parts of an AK type firearm into which the system is installed, shown in a rest position before the trigger has been pulled to initiate a firing cycle.

As shown in FIG. 5, in the rest or starting condition or position of the firearm, the exchangeable spring 8, which has a selected length, keeps a forward end of the outer tube 23 spaced from a forward surface 32 of the bolt carrier 33 before a firing cycle starts.

Assuming a round is properly loaded in the receiver in a known manner, when the trigger is pulled, a firing cycle begins. The bolt carrier 33 then moves rearwardly in the direction of arrow in FIG. 6, in the receiver while the exchangeable spring 8 and the central spring 6 compress during an initial part of the firing cycle. This continues until the forward ends of the outer tube 23 and of the central buffer tube 21, together contact the forward surface 32 of the bolt carrier 33.

Whether heavy or light loaded rounds are utilized, the system of the invention will cycle at least to the position of FIG. 6 in most cases, and, in the case of a light load, the bolt carrier may then start its forward motion to strip a new round from the top of the magazine and load the firearm for the next cycle.

For heavier loaded rounds, the bolt carrier 33 will continue moving rearwardly to the position of maximum compression shown in FIG. 7. The movement of the bolt carrier 33, from FIG. 6 to FIG. 7, is moderated by the buffering action of the invention, as buffer springs 2 and 4 compress during a later phase of the firing cycle with heavier loads, until as shown in FIG. 7, a rearward surface 44 of the bolt carrier 33 contacts a stop surface 42 of a bolt carrier stop part 31 in the receiver.

Rear buffer spring 4 and possibly also the axle spring 2, have greater compression strengths as compared to the central spring 6 and the exchangeable spring 8, so that springs 2 and 4 compress mostly or only during this later buffering phase of the firing cycle from FIG. 6 to FIG. 7.

The start of the firing cycle is illustrated by the difference in bolt carrier position between FIG. 5 to FIG. 6. This phase of movement is here called a reload movement of the bolt carrier 33, because even if the rearward movement ends at FIG. 6, the firearm will still reload as the bolt carrier thereafter moves forward. During the rearward reload movement, a lower biasing force of, for example, about 3 to 3.5 kg (about 6.6 to 7.7 lbs) is exerted by the system, mostly by virtue of the biasing forces of springs 6 and 8.

During a later, buffering movement or phase of the firing cycle, illustrated by the difference in bolt carrier position between FIG. 6 to FIG. 7, because a round of enough power is fired, the bolt carrier moves rearwardly further, under a higher buffering force of, for example, about 5.5 to 6 kg (about 12 to 13 lbs).

Stated differently, from FIG. 5 to FIG. 6 mostly or only the springs 8 and 6 compress and spring 4 compresses slightly and spring 2 does not compress at all at the instant of FIG. 6 when the forward ends of the central buffer tube 21 and the outer tube 23 first strike the surface 32. From that point toward FIG. 7, the bolt carrier 33 moves further rearwardly and during this time the axle buffer spring 2 starts compressing for the first time, adding resistence to the recoil action along with the heavy rear buffer spring 4, until the end of this rearward movement of the bolt carrier shown in FIG. 7. The reason springs 4 and 2 are called buffer springs is because during the reload movement of firing cycle from FIG. 5 to FIG. 6, the central spring 6 and the exchangeable spring 8 are most active, but from the phase of FIG. 6 to the phase of FIG. 7, i.e. during the rearward buffering movement, the buffer springs 2 and 4 take over and contribute much more forward biasing force than the springs 6 and 8 did.

Another characteristic of the invention is that because of the relatively lighter biasing force exerted by the system from FIG. 5 to FIG. 6, either heavy loads or light loads can be utilized successfully. This is because the sufficient, reload movement stroke of the firing cycle between the images of FIGS. 5 and 6, is at a lower pressure and recoil bias provided by exchangeable 8 and central spring 6 so even if the firing cycle does not move the bolt carrier 33 any further back than FIG. 6, the bolt carrier 33 will still then move forward and load the next round.

From FIG. 6 to FIG. 7 the buffer springs 2 and 4 begin to operate and this provides much higher recoil biasing force to the end of the rearward movement of the bolt carrier.

In this way both light and heavy loads can be utilized and the system of the invention will effectively cycle and, where needed, buffer the recoil of the weapon.

Various lengths and/or compression strengths can be selected for the exchangeable spring 8, to suit the needs and desired recoil and reload characteristics of the firearm. Also the telescopic recoil system of the invention requires the axle 17, the central buffer tube 21, the outer tube 23 and the spring buffer tube 19, to have selected relative lengths as illustrated, that permit the bolt carrier 33 to execute a reload movement from FIG. 5 to FIG. 6, and a buffering movement from FIG. 6 to FIG. 7, in the receiver 110.

FIG. 4 illustrates an 11 step process for assembling the telescopic recoil system of the invention.

As shown on FIG. 4, the first step for assembling the telescopic recoil system of the invention, is to insert the rearward end of axle 17 into the forward open end of central buffer tube 21. Step 2 insertion of the combined axle plus tube assembly 17, 21, into the forward end of outer tube 23. Step 3 is the insertion of axle buffer spring 23 onto the rearward end of axle 17. Step 4 is the engagement of central spring 6 over the rearward portion of outer tube 23.

Step 5 is the engagement of the forward end of buffer spring 4 over the rearward end of spring buffer tube 19. Step 6 is the insertion of spring buffer tube 19 into the forward end of buffer spring 4 until spring 4 engaged flange 19*a*. Step 7 is the engagement of the rear end of buffer spring 4 onto plug portion 15*a* and against flange 15*d*. Step 8 is the threading of plug 15 into the rearward end of axle 17 until axle 17 is firmly threaded onto the threaded end 15*c* of the plug 15.

Step 9 is the insertion of plug 15 onto the rear end of axle buffer spring tube 2. Step 10 is the insertion of the extension 15*b* of plug 15 into the axle bore 13*c* of base portion 13*a* until the plug is fully seated in the recoil system base 13. The finally step 11 is the insertion of locking pin 11 into the transverse bore 13*b* to extend into recess 15*e* and positively lock the plug 15 to the base portion of 13*a*.

While a specific embodiment of the invention has been shown and described in detail to illustrate the application of the principles of the invention, it will be understood that the invention may be embodied otherwise without departing from such principles.

What is claimed is:

1. A telescopic recoil system for a firearm having a receiver and a bolt carrier (33) movable rearwardly in the receiver during an initial part of a firing cycle, and forwardly in the receiver during an ending part of the firing cycle, the recoil system comprising:

a recoil system base (13);

an axle (17) fixed to the base (13);

a central buffer tube (21) slidably mounted on the axle (17);

an axle buffer spring (2) engaged between the base (13) and the central buffer tube (21) for biasing the central buffer tube (21) away from the base (13);

an outer tube (23) slidably mounted on a forward portion of the central buffer tube (21);

a spring buffer tube (19) slidably mounted on a rearward portion of the central buffer tube (21);

a rear buffer spring (4) engaged between the base (13) and the spring buffer tube (19) for biasing the spring buffer tube (19) away from the base (13);

a central spring (6) engaged between the spring buffer tube (19) and the outer tube (23) for biasing the outer tube (23) away from the spring buffer tube (19) and away from the base (13); and an exchangeable spring (8) engaged between the outer tube (23) and the bolt carrier (33) for biasing the outer tube (23) away from the bolt carrier (33).

2. The telescopic recoil system of claim 1, wherein the central spring (6) and the exchangeable spring (8) have a biasing force sufficiently lower than the rear buffer spring (4) to allow a reload movement of the bolt carrier (33) to occur, whether the rear buffer spring (4) and the axle buffer spring (2) are compressed during a buffering movement of the bolt carrier (33) or not.

3. The telescopic recoil system of claim 1, wherein the recoil system base (13) includes a base portion (13*a*) having an axial bore (13*c*), and a threaded connection plug (15) having a plug portion (15*a*) with a base extension (15*b*) extending into the axial bore (13*c*) and a threaded portion (15*b*) threaded into the axle (17).

4. The telescopic recoil system of claim 1, wherein the axle (17), the central buffer tube (21), the outer tube (23) and the spring buffer tube (19) each have selected relative lengths that permit the bolt carrier (33) to execute a reload movement and a buffering movement in the receiver.

5. The telescopic recoil system of claim 1, wherein the rear buffer spring (4) has a higher compression resistance than the central spring (6) so that the rear buffer spring (4) compresses later than the central spring (6) during a firing cycle.

6. The telescopic recoil system of claim 1, wherein the spring buffer tube (19) includes a flange (19*a*) for separating the rear buffer spring (4) from the central spring (6) on the spring buffer tube (19).

7. The telescopic recoil system of claim 1, wherein the outer tube (23) includes a flange (23*a*) for separating the central spring (6) from the exchangeable spring (8) on the outer tube (23).

8. The telescopic recoil system of claim 1, wherein the central buffer tube (21) has a large outside diameter forward end (21*a*) and the outer tube (23) has a small inside diameter rearward end (23*b*) for engaging the large outside diameter forward end (21*a*) of central buffer tube (21) retain the central buffer tube (21) to the outer tube (23).

9. The telescopic recoil system of claim 1, wherein the axle (17) has a large outside diameter forward end (17*a*) and the central buffer tube (21) has a small inside diameter rearward end (21*b*) for engaging the large outside diameter forward end (17*a*) of axle (17) retain the axle (17) to the central buffer tube (21).

10. The telescopic recoil system of claim 1, wherein the exchangeable spring (8) has a length that keeps a forward end of the outer tube (23) spaced from a forward surface (32) of the bolt carrier (33) before a firing cycle, the exchangeable spring (8) compressing during a firing cycle until the forward end of the outer tube (23) contacts the forward surface (32) of the bolt carrier (33), the bolt carrier (33) moving rearwardly in the receiver during the firing cycle until a rearward surface (44) of the bolt carrier (33) contacts a stop surface (42) of a bolt carrier stop part (31) in the receiver.

11. The telescopic recoil system of claim 1, wherein the exchangeable spring (8) has a length that keeps a forward end of the outer tube (23) spaced from a forward surface (32) of the bolt carrier (33) before a firing cycle, the exchangeable spring (8) compressing during a firing cycle until the forward end of the outer tube (23) contacts the forward surface (32) of the bolt carrier (33), the bolt carrier (33) moving rearwardly in the receiver during the firing cycle until a rearward surface (44) of the bolt carrier (33) contacts a stop surface (42) of a bolt carrier stop part (31) in the receiver, the rear buffer spring (4) and the axle spring (2) having a compression strength compared to the central spring (6) for compressing mostly during a later part of the firing cycle.

12. A telescopic recoil system for a firearm having a receiver and a bolt carrier, comprising:

a recoil system base;

an axle fixed to the base;

a central buffer tube slidably mounted on the axle;

an axle buffer spring between the base and central buffer tube, biasing the central buffer tube away from the base;

an outer tube slidably mounted on a forward portion of the central buffer tube;

a spring buffer tube slidably mounted on a rearward portion of the central buffer tube;

a rear buffer spring between the base and spring buffer tube, biasing the spring buffer tube away from the base;

a central spring between the spring buffer tube and outer tube, biasing the outer tube away from the spring buffer tube and away from the base; and an exchangeable spring between the outer tube and the bolt carrier, biasing the outer tube away from the bolt carrier.

13. The telescopic recoil system of claim 12, wherein the central spring and the exchangeable spring have a biasing force sufficiently lower than the rear buffer spring to allow a reload movement of the bolt carrier to occur, whether the rear buffer spring and the axle buffer spring are compressed during a buffering movement of the bolt carrier or not.

14. The telescopic recoil system of claim 12, wherein the recoil system base includes a base portion having an axial bore, and a threaded connection plug having a plug portion with a base extension extending into the axial bore and a threaded portion threaded into the axle.

15. The telescopic recoil system of claim 12, wherein the axle, the central buffer tube, the outer tube and the spring buffer tube each have selected relative lengths that permit the bolt carrier to execute a reload movement and a buffering movement in the receiver.

16. The telescopic recoil system of claim 12, wherein the rear buffer spring has a higher compression resistance than the central spring so that the rear buffer spring compresses later than the central spring during a firing cycle.

17. The telescopic recoil system of claim 12, wherein the spring buffer tube includes a flange for separating the rear buffer spring from the central spring on the spring buffer tube.

18. The telescopic recoil system of claim 12, wherein the outer tube includes a flange for separating the central spring from the exchangeable spring on the outer tube.

19. The telescopic recoil system of claim 12, wherein the central buffer tube has a large outside diameter forward end and the outer tube has a small inside diameter rearward end for engaging the large outside diameter forward end of central buffer tube retain the central buffer tube to the outer tube.

20. The telescopic recoil system of claim 12, wherein the axle has a large outside diameter forward end and the central buffer tube has a small inside diameter rearward end for engaging the large outside diameter forward end of axle retain the axle to the central buffer tube.

* * * * *